United States Patent [19]

Anschütz et al.

[11] 4,300,302

[45] Nov. 17, 1981

[54] RETAINING AND ADJUSTING DEVICE FOR THE PISTOL GRIP OF A FIRE ARM

[75] Inventors: Dieter Anschütz; Dieter Straub, both of Ulm, Fed. Rep. of Germany

[73] Assignee: J. G. Anschütz GmbH, Ulm, Fed. Rep. of Germany

[21] Appl. No.: 57,827

[22] Filed: Jul. 16, 1979

[30] Foreign Application Priority Data

Jul. 20, 1978 [DE] Fed. Rep. of Germany ..... 2832015

[51] Int. Cl.[3] ..... F41C 23/00

[52] U.S. Cl. ..... 42/73

[58] Field of Search ..... 42/73, 72, 71 R, 71 P, 42/75 C

[56] References Cited

U.S. PATENT DOCUMENTS

| | | | |
|---|---|---|---|
| 703,964 | 7/1902 | Mosbaugher | 42/71 R |
| 2,832,166 | 4/1958 | Ivy | 42/72 |
| 3,899,845 | 8/1975 | Wild et al. | 42/75 C |

FOREIGN PATENT DOCUMENTS

| | | | |
|---|---|---|---|
| 196864 | 6/1965 | Sweden | 42/71 R |
| 106412 | 5/1917 | United Kingdom | 42/72 |

*Primary Examiner*—Charles T. Jordan
*Attorney, Agent, or Firm*—Holman & Stern

[57] ABSTRACT

An adjustable pistol grip for a competition rifle or the like having three basic embodiments. In one embodiment, balls and sockets are located in the pistol grip and stock or body of the rifle. The balls and sockets are connected by a rod which is adjustably clamped either by a hydraulic piston, screw ring or expanding ball, in the socket. The connecting rod may be two part, each displaceably clampable relative to the other. Another embodiment employs a flexible wire fixed to the stock and pistol grip. On the wire are perforated balls alternating with short cylinders and a screw or lever which can apply tension to the array to hold the pistol grip required in any position in relation to the stock. Another embodiment employs a universal joint, one member of which is rigidly fixed to the pistol grip or stock, and the other member of which is rigidly fixed to a rod which is adjustably held in a mount supplied with a clamp. A single piece supplied with two perpendicular bores joins the members of the universal joint which may be adjustably clamped therein.

21 Claims, 9 Drawing Figures

RETAINING AND ADJUSTING DEVICE FOR THE PISTOL GRIP OF A FIRE ARM

BRIEF SUMMARY OF THE INVENTION

The invention relates to a retaining and adjusting device for a pistol grip of a fire arm, particularly a three-position competition rifle, consisting of a handle piece, with or without integrated trigger guard, with which the pistol grip can be fixed in different positions on the stock or body of the fire arm.

Hitherto, pistol grips which can be fixed in different positions on the stock or body of a rifle have not been known.

Instead, pistol grips on rifles have without exception been rigidly and inseparably connected to the stock, and have been produced in one piece therewith. Particularly in the case of competition rifles, an invariable location of the pistol grip can entail disadvantages which reside in the fact that the competitive marksman cannot assume, with the hand gripping the pistol grip and in a less inconvenient way with the relevant arm, the attitude which is optimum for him or to which he has been accustomed from other competition rifles. He is therefore compelled, during the shooting competition which as a rule extends over a prolonged period of time, to put up with a more or less inconvenient and forced attitude of these limbs and members. The forced attitude effects particularly the wrist which is bent and cannot be held straight, as would be actually desirable in order to achieve substantial freedom from fatigue and comfort of the limbs combined with maximum possible sensitivity and also fine control of the trigger finger movement.

The relative malpositioning of a pistol grip can have various causes. On the one hand, it can happen because the marksman tilts the rifle in relation to its vertical axis as he brings it into the firing position, in order to establish proper contact of the butt plate with his shoulder and to allow an uncramped position of neck and head when aiming. Despite the disadvantageous position of the wrist, this tilting of the rifle is tolerated relatively frequently because the advantages which can be achieved by it are regarded as being of greater importance.

Another cause is individual differences in the dimensions of the human body and the ratio of sizes of different parts of the body in respect of one another in comparison with the average (e.g. arms which are too short or too long).

The relative position of the pistol grip in respect of the marksman is quite substantially affected by the nature of the firing position. In competitive shooting, there are of course three types of firing position—standing, kneeling and prone, each requiring basically different attitudes of hand, arm and head. Even if the pistol grip is of the optimum design and is in the optimum position for one of these three types of firing position, it will not suffice for the other types. One solution to this problem has been to provide, in the case of three-position firing, a special interchangeable stock or even a separate rifle for each type of firing position, but this is complicated and entails considerable cost.

The present invention seeks to solve the problem by providing a retaining and adjusting device for a pistol grip which can be fixed in a variable position on the stock or body of a fire arm.

According to the invention, the retaining and adjusting device is an articulating mechanism consisting of rotating and/or sliding bearings, adapted for rotary and/or translatory movement in several axes and capable of being locked in any attainable position.

Such a retaining and adjusting device makes it possible, within the envisaged range of adjustment, to bring the pistol grip into any desired position in relation to the rifle and to lock it in that position. Thus, the advantage of versatile adaptability both to different types of firing position and habits as well as to different types of stature of the marksmen using the rifle is obtained.

The pistol grip must be understood to mean the unit comprising the handle piece which is held by the trigger hand, and the trigger guard.

This unit ensures that, whatever positional change may occur, the trigger guard is always in the same relative position to the handle piece. This is important as otherwise the freedom of movement of the trigger finger might be restricted by the trigger guard. Triggers, adjustable transversely and longitudinally in relation to the weapon are already known so that if the pistol grip is moved, corresponding readjustment of the trigger can avoid differences in positions of the trigger finger.

It is therefore particularly expedient to mount the trigger on the trigger guard (see U.S. Pat. No. 3,899,845), because in such a case, all other sources of trouble arising from pistol grip movement are avoided. In such a case, a flexible or distance-independent transmission of trigger movements or triggering signals must be ensured. This can occur for example in known manner, in the case of purely mechanical triggering devices, by means of wire transmission systems, or in the case of electric triggering devices, by means of flexible electric conductors.

Naturally, there can also be reasons for foregoing integration of the trigger guard with the pistol grip, for example, when converting existing weapons from rigid to adjustable pistol grips or in the case of trigger guards which are rigid components of the triggering device. In these cases, nevertheless, satisfactory results can still be obtained by multi-axial tilting, rotation and displacement of the pistol grip.

Various embodiments which comprise multi-axial displaceability of the articulating mechanism and thus of the pistol grip are suggested hereinafter:

The articulating mechanism may consist of a socket mounted on the stock or on the body of the fire arm and one mounted on the pistol grip, and each having a single or multi-part ball mounted to be securely clamped therein, and a rod connecting the two balls.

For the construction of the rod, there are two alternative principles: either the rod is a continuous member connected rigidly to the balls and affording no opportunity for the axial distance between the two balls to be altered, or it may consist of parts which are axially adjustalbe in respect of one another or it may be separably and longitudinally movably fixed to at least one of the balls. The first alternative is less complicated. However, it is not possible with it to achieve the same universal facility for adjustment and positioning of the pistol grip as with the second alternative. Nonetheless, for practical purposes, it is adequate if the demands made of it are not too exacting.

The clamping of the single or multi-part balls in the sockets and with the possibly longitudinally movable rod is possible in various ways. As is described in greater detail hereinafter, clamping means are used which either press on the balls or ball parts from outside or move them away from one another from within, and which operate by means of clamping screws, hydraulic force transmission means or the wedge principle.

A further embodiment of articulating mechanism consists of a chain comprising a high-strength steel wire strand with several perforated balls arranged in a row thereon and alternating with short cylindrical portions of tube and with, arranged at one end, a likewise axially drilled tensioning screw, the two ends of the steel wire strand each being anchored in rigid abutments in the stock or system and pistol grip respectively, the tensioning screw being screwed into one of these abutments. Tightening the tensioning screw rigidifies the whole chain while slackening it makes the chain movable.

Another articulating mechanism comprises a swivel joint consisting of two cylindrical bolts which, with negligible lateral spacing, are disposed in intersecting bores in a clamping member in such a way as to be axially displaceable and rotatable and lockable by means of clamping screws, while they have both ends fixed to the arms of respective U-shaped members. On the base of one U-shaped member which carries the two arms there is rigidly fixed a third bolt which is at a right-angle to the other two bolts and which is held in rotatable, axially displaceable and lockable fashion in a mounting secured in the stock. The other U-shaped member of the swivel joint is fixed to the pistol grip.

If the trigger guard is integral with the pistol grip, it is advantageous for the articulating mechanism to be fixed on only the front trigger guard and the front stock or front part of the weapon body, because no interfering components are then located in the gripping area.

All articulating mechanisms described can of course, not only be used individually but also in pairs or even three-fold on one rifle. It is possible and on occasion may even be advantageous to combine different constructions with one another. With multiple arrangements, the articulating mechanisms can have their main axes disposed at an angle to one another, parallel or on the grip portion and on the trigger guard.

BRIEF DESCRIPTION OF SEVERAL VIEWS OF THE DRAWINGS

A plurality of examples of the invention are described hereinafter and in the accompanying drawings. For disclosure of all the details not explained in full hereinafter, reference is made to the illustrations given in the drawings, in which.

DETAILED DESCRIPTION

Figure 1:
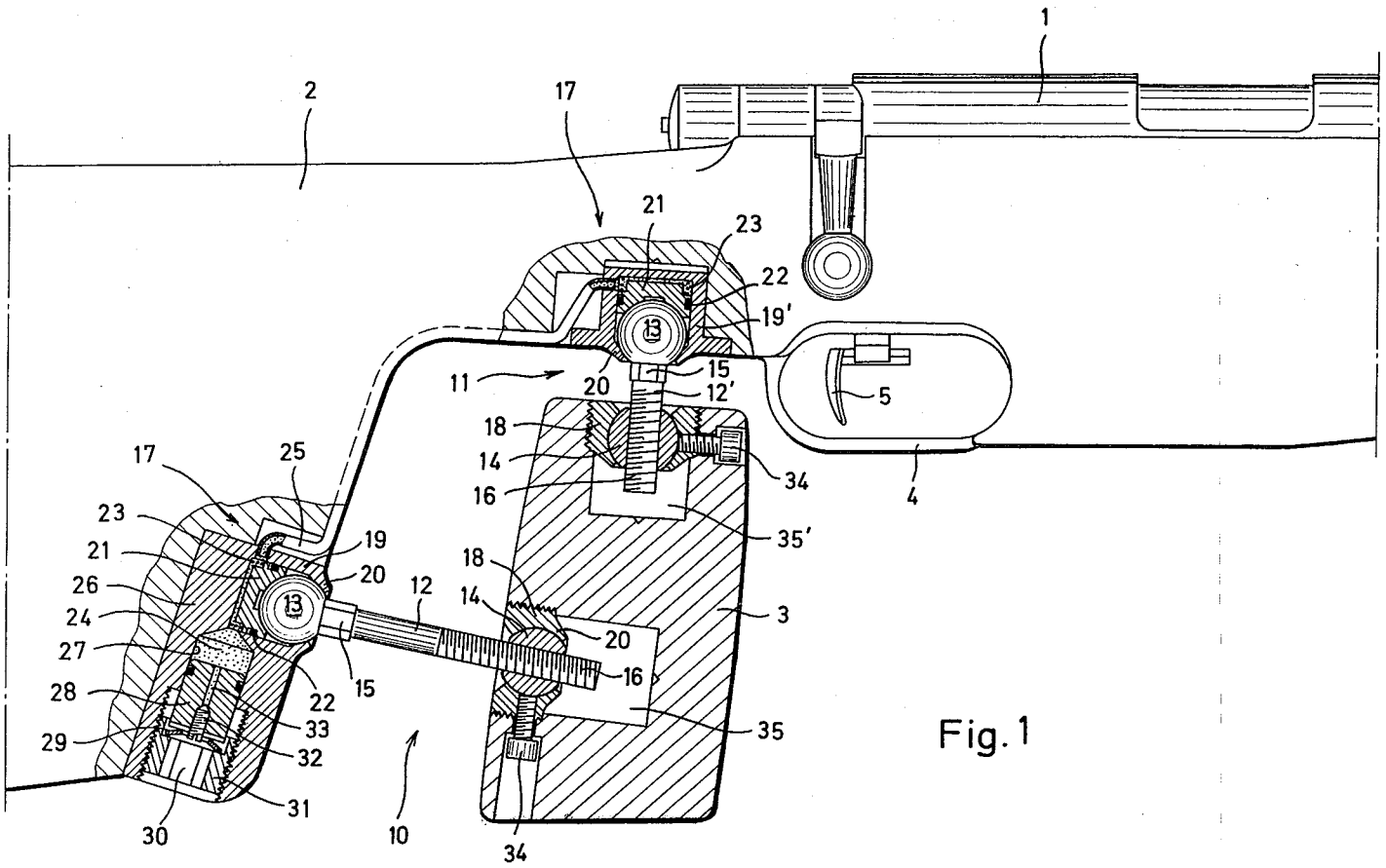
FIG. 1 is a partially illustrated rifle in side elevation with the pistol grip shown in cross-section and showing a first embodiment of the retaining and adjusting device.
Figures 7, 8:
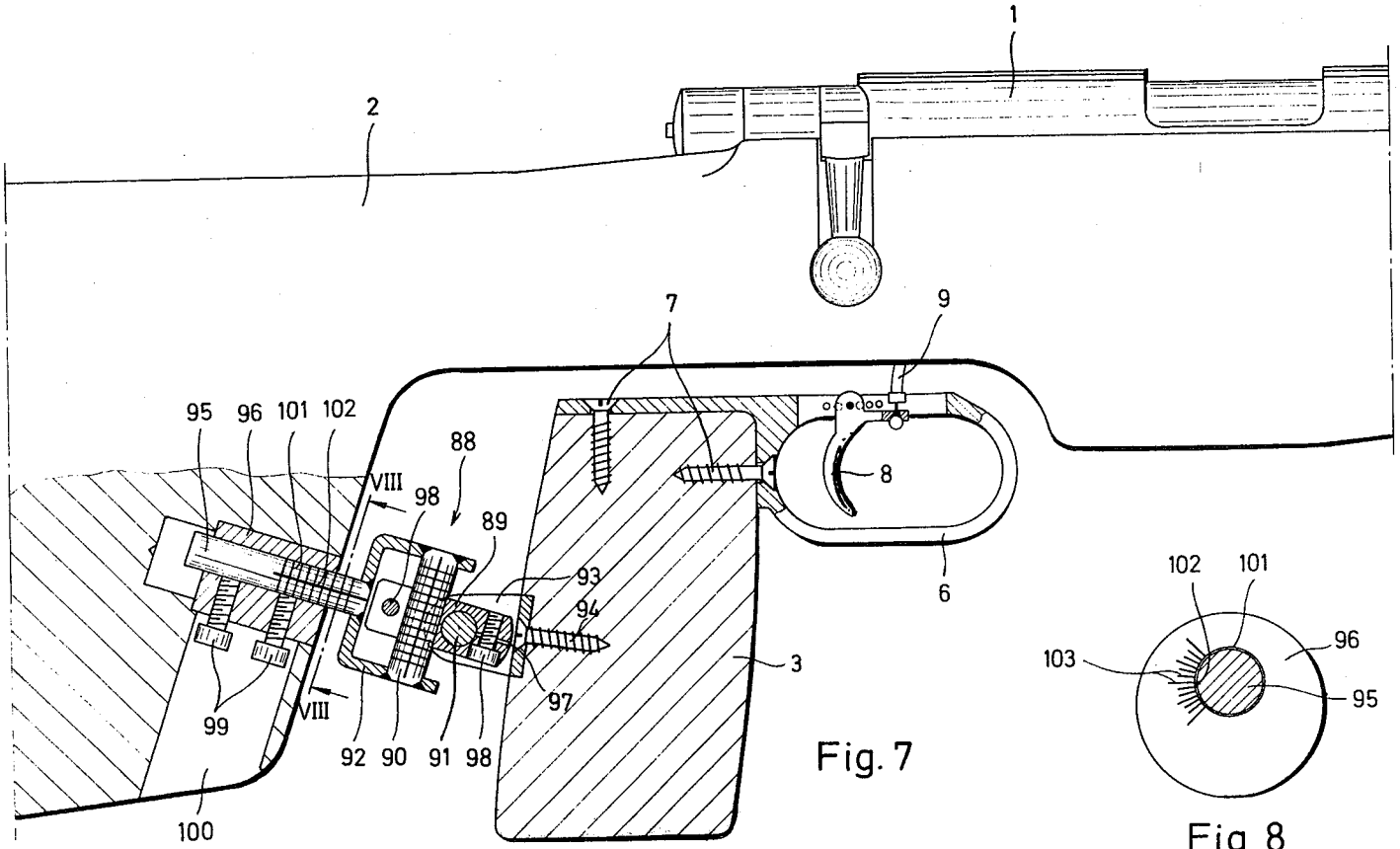
FIG. 7 is a partial elevational view, partly in cross-section, of a rifle according to FIG. 1 showing a sixth embodiment of the retaining and adjusting device.
FIG. 8 shows a cross-section through the retaining and adjusting device taken along line VIII—VIII in FIG. 7.
Figure 9:
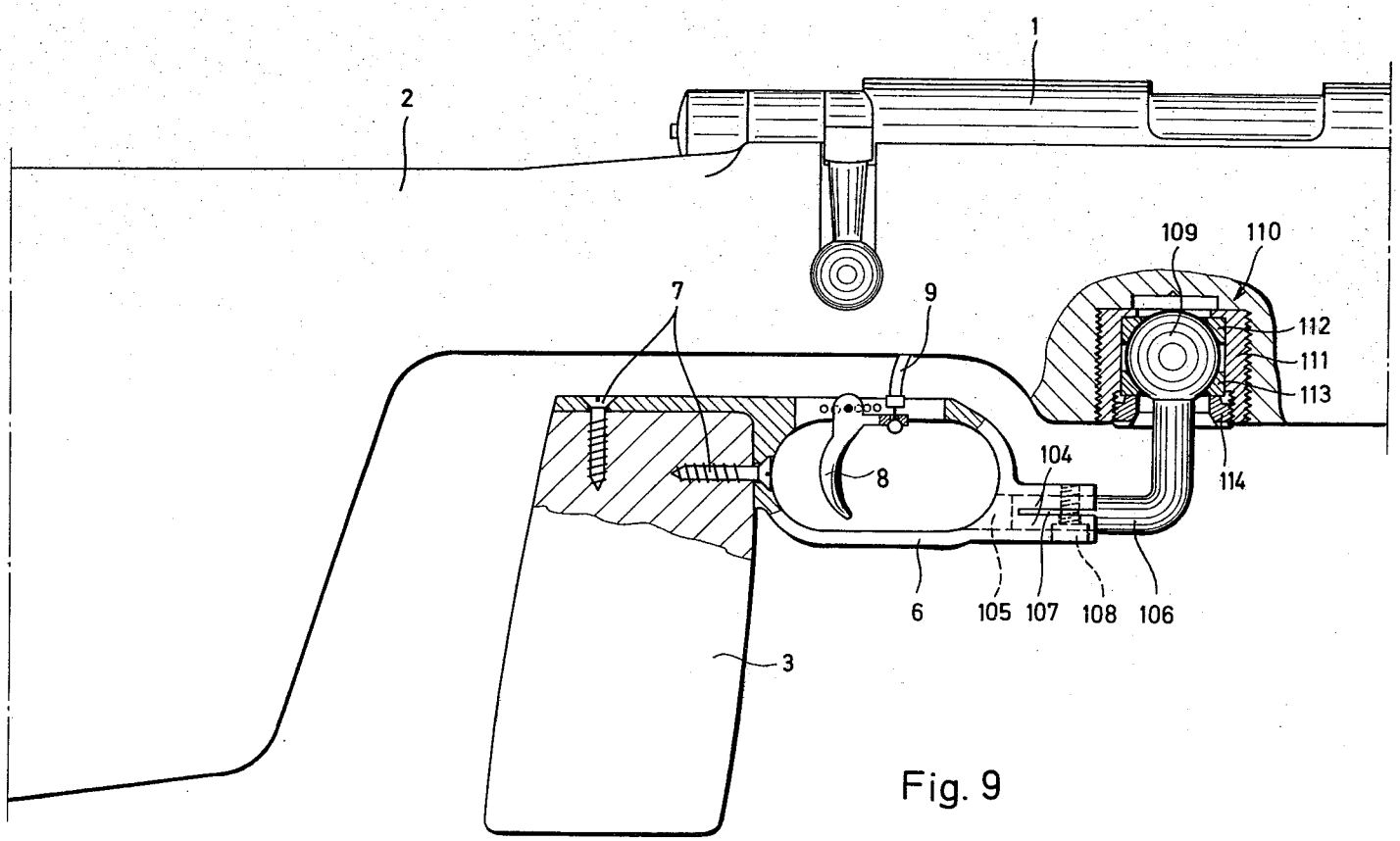
FIG. 9 is a partial elevational view, partly in cross-section, of a rifle according to FIG. 1 or 7 showing a seventh embodiment of the retaining and adjusting device.

To illustrate the field of application, the interaction with the weapon and different instances of mounting of the object of the invention which is reproduced in a plurality of forms of the embodiment, FIGS. 1, 7 and 9 in each case show part of a competition rifle consisting of a body 1 with a stock 2 mounted thereon and a pistol grip 3. In contrast to the other two rifles, the rifle according to FIG. 1 has a trigger guard 4, which is fixed on the body 1 or on the stock 2 and a trigger 5 which is part of a triggering device not shown and which is adjustable in two directions.

The other two rifles illustrated in FIGS. 7 and 9 have in contrast, a trigger guard 6 which is an integral component of the pistol grip 3, being fixed by screws 7. This trigger guard 6 mounts in rotatable fashion a trigger 8 which can be variously postioned in the longitudinal direction of the weapon, co-operating via a flexible wire transmission 9 with a triggering device which is likewise not illustrated here. The wire transmission 9 may be replaced by another component which may be flexible or capable of compensating for differences in length, and being suitable for transmitting forces and movements or other forms of energy. Suitable are for example flexible hydraulic bases and stranded electric cables.

FIG. 1 additionally shows a retaining and adjusting device for the pistol grip 3, consisting of two substantially identically constructed articulating mechanisms 10 and 11 which are disposed in different axes. Each of them has a pair of balls 13 and 14 connected by a rod 12, 12', the ball 13 being rigidly connected at the end of the rod 12 or 12' which is provided with key surfaces 15 while the ball 14 which has a threaded bore passing through it, is screwed onto a matching screwthread 16 on the other end of the rod 12 or 12'.

The ball 13 is movably and lockably mounted in a twopart socket 17 fixed in the stock 2 while the ball 14 is movable and lockably mounted in a one-piece socket 18 rigidly inserted into the pistol grip 3. The socket 17 has a pot-shaped first socket half 19, 19' which, like the socket 18, has a collar 20 applied by re-shaping of material against the ball 13, 14 and enclosing it in the socket 17, 18. The second part of the socket 17 consists of a hydraulic piston 21 partially enclosing the half of the ball 13 which is remote from the rod. This hydraulic piston 21 is mounted for longitudinal displacement in the cylindrical part of the pot-shaped first socket half 19, 19'. It has on its periphery a sealing ring 22 let into an annular groove and is held in contact with the ball 13 by a coil spring 23. The sides of the two hydraulic pistons 21 which are remote from the balls 13 are subject to the action of a hydraulic fluid 24 and are hydrostatically coupled to each other via pipeline 25 linking the two cylinder spaces of the socket halves 19, 19'.

In a block 26 directly connected to the socket half 19 and communicating with the cylinder space thereof and via this also with the pipeline 25 is a second cylinder 27 which is filled with the already-mentioned hydraulic fluid 24. Running in the cylinder 27 is a piston 28 which, via an elastic intermediate member in the form of a plate spring 29, can be pressed into the cylinder 27 to reduce the cylinder space, by a bolt 31 having a hexagonal socket head 30. The hydrostatic pressure which arises thereby in the hydraulic fluid 24 presses the hydraulic pistons 21 which are subject to it firmly against the balls 13, clamping them against the socket halves 19, 19'. The piston 28 has a vent screw 32 which normally occludes a cental passage 33 and which is screwed out in order to vent the hydraulic system.

The balls 14 screwed onto the opposite ends of the rods 12, 12' are clamped securely by externally accessible clamping screws 34 which are screwed into the sockets 18. These clamping locations serve less to support the stability of the position of the rods 12 which is adequately ensured by the hydraulic clamping of the balls 13, than instead to prevent undesired rotary movements of the pistol grip 3 about the imaginary axis extending through the centre points of the two balls 14.

To vary the distance between the balls 13 and 14 which are mounted on the rod 12 and 12' respectively, the hydraulic clamping of the balls 13 is slackened by anti-clockwise rotation of the screw 31 and the rod 12, 12' is rotated by means of a spanner fitted to the key faces 15, so that the ball 14 becomes screwed into a different position on the screwthread 16. At the same time, clamping of the ball 14 by the clamping screw 34 would ony be just strong enough to prevent the ball co-rotating with the rod 12, 12'. In the even of movement of the pistol grip 3, to ensure that the rod 12, 12' has sufficient freedom of movement, provided therein are spaces 35, 35' in the form of cylindrical recesses.

Figure 2:
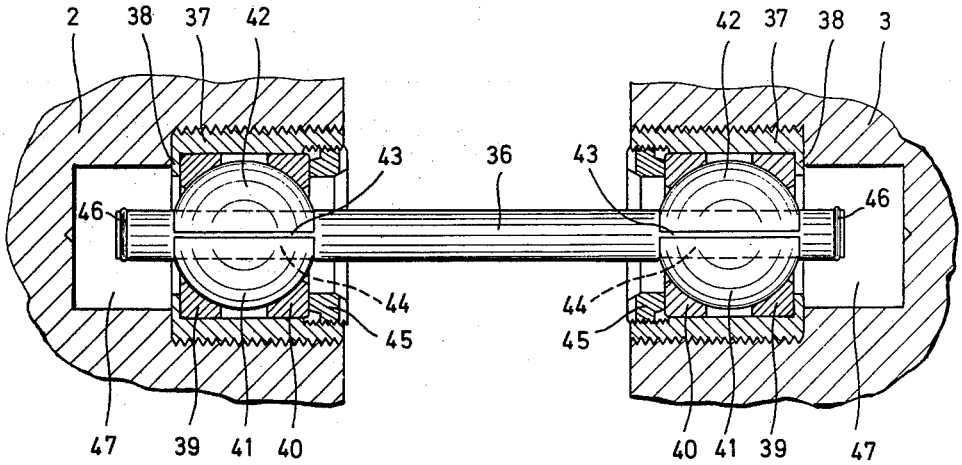
FIG. 2 is a cross-sectional view of a second embodiment of the retaining and adjusting device.

FIG. 2 shows a second embodiment of the retaining and adjusting device. In this case, the two ball joints which are coupled to each other by a cylindrical smooth rod 36 are of entirely identical construction and therefore their component parts bear the same reference numerals.

Rigidly screwed into the stock 2 and the pistol grip 3 is in each case an externally screwthreaded bush 37 having on its inner end face a narrow shoulder 38 which narrows the internal shape. Located inside this bush 37 are a socket ring 39 adjacent the shoulder 38 and an outer socket ring 40 which is at an axial distance from and laterally rotated in respect of the ring 39. Both socket rings 39 and 40 serve as a bedding for two hemispheres 41 and 42 which together make up a solid ball and the plane faces of which form between them, orientated in the longitudinal direction of the rod 36, a space provided by a separating gap 43. The hemispheres 41 and 42 are both of equal size and have prismatic or semi-cylindrical pits opening towards the separating gap and which go together in pairs to provide a prismatic or cylindrical bore 44, the inside diameter of which is the same as the diameter of the rod 36. The rod 36 extends through this bore 44.

A threaded ring 45 is externally accessibly screwed into the bush 37 and presses the outer socket ring 40 against the hemispheres 41 and 42, which are thus in turn pressed against the rod 36 as well as against the socket ring 39. The consequence of this is a clamping of the ball joint and of the rod 36 which can be removed again by slackening the threaded ring 45. So that the rod 36 cannot slip out of the bores 44, a retaining ring 46 is fitted into an annular groove at each end. Freedom of movement for the rod 36 is provided by in each case a cylindrical recess 47 in the stock 2 or in the pistol grip 3, as the case may be.

With this construction, it is likewise possible to carry out any conceivable adjustment with the pistol grip 3 and to lock it in any attainable position.

Figure 3:
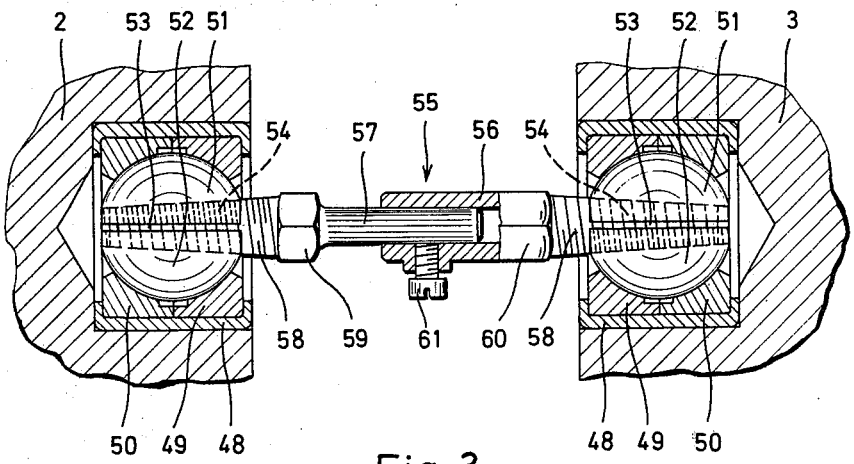
FIG. 3 is a cross-sectional view of a third embodiment of the retaining and adjusting device.

FIG. 3 shows a third embodiment of the articulating mechanism. Since here, too, both sides are identical, identical reference numberals are used for all those parts which are the same.

A tubular housing 48 rigidly encloses in each case two identically sized socket rings 49 and 50 which together form one unit. These socket rings 49, 50 for their part engage around two hemispheres 51 and 52 which form a solid ball and which have in the centre, between them, a separating gap 53. The two half balls 51, 52 have a common central conical threaded bore 54 which is open towards the separating gap. Because these are difficult to produce by metal cutting production methods, it is intended that the half balls or hemispheres 51, 52 be produced by die casting from synthetic plastics or pressure die casting from metals. The ball joint consisting of the said and inseparably form-lockingly connected parts 48 to 52 is in each case immovably inserted into identical-diameter cavities in the stock 2 and pistol grip 3.

A rod 55 consisting of two telescopically interengaging parts, a sleeve 56 and a journal 57 guided for axial displacement therein, has bilaterally conical threaded projections 58 at opposite ends and key faces 59, 60. The conical threaded projections 58 are in each case screwed into the conical threaded bores 54 in the pairs of hemispheres 51, 52. Screwing the ball joint firmly together by means of a spanner which can be applied to the key faces 59, 60 causes the hemispheres 51 and 52 to be pried apart, pressed very firmly against the pair of socket rings 49, 50 to which they become clamped. Only after clamping of the hemispheres 51, 52 is complete can the parts of the rod 55 also be clamped in any desired relative position to one another by a clamping screw 61.

Figure 4:
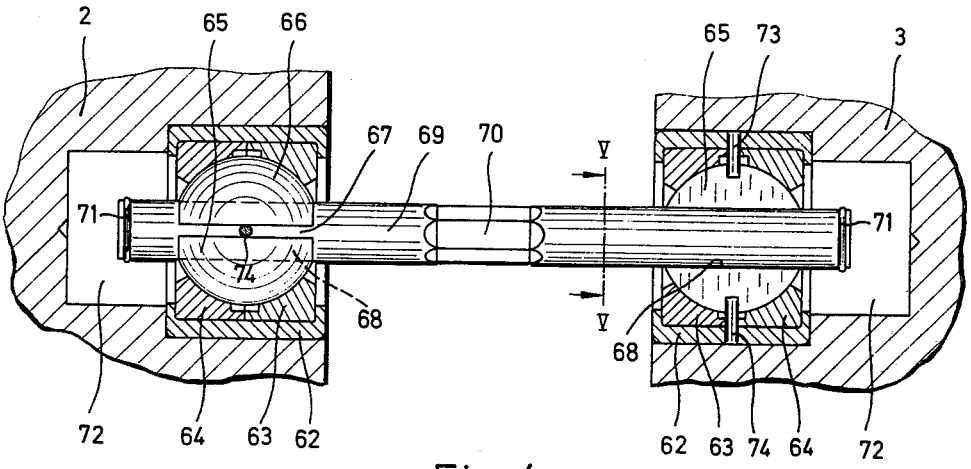
FIG. 4 is a cross-sectional view of a fourth embodiment of the retaining and adjusting device.

FIG. 4 shows a further example of an embodiment of the articulating mechanism which in construction and mode of operation is similar to those described above. Here, too, there is in each case a cylindrical housing 62 open at the ends which is firmly inserted into the stock 2 and also into the pistol grip 3. The housing encloses non-rotatable socket rings 63 and 64 which are disposed in pairs and which mount in their cavity two hemispheres 65 and 66 which together make up a solid ball, being movable therein and forming a separating gap 67 between them. Shown in side elevation in the left-hand part of FIG. 4 are the two hemispheres 65 and 66, while the right-hand side shows a front view, in which the hemisphere 66 is removed and only the hemisphere 65 can be seen, together with its plane separating gap face.

The pairs of half balls or hemispheres 65, 66 have, open towards the separating gap 67, a common, central like-directioned prismatic aperture 68 having an arcuately quadratic cross-sectional profile (FIG. 5) greatly resembling a circular form. The cross-sectional profile has variously intense curvatures of radii r and R which occur in a regular four-fold sequence. A rod 69 with a cross-sectional profile which in form and size agrees with the profile of the aperture 68 and which has key faces 70 disposed in the middle zone is in each case inserted on both sides into the aperture 68 is secured against withdrawal by terminal retaining washers 71. Spaces 72 in the form of cylindrical recesses in the stock 2 and pistol grip 3 provide freedom of movement of the rod ends when the pistol grip 3 is moved.

The joint clamping of rod 69 and ball joints takes place by rotation of the rod 69 with a spanner which can be fitted on the key faces in any desired direction. While this is happening, the polygonal profile of the rod 69 and of the aperture 68 pries apart the half balls 65 and 66, with the result that they become force-lockingly connected to the socket rings 63 and 64 and permit no further relative movement. Similarly, the rod itself is securely clamped. However, so that the two pairs of half balls, comprising half balls 65, 66 in the stock 2 as well as in the pistol grip 3, cannot rotate jointly or in relation to one another during the clamping process, which would make simultaneous clamping or any kind of clamping difficult or impossible, two cylindrical pins 73 and 74 are provided which are fixed in the housing 62 and which penetrate radially into the separating gap 67 between the hemispheres 65, 66. The axes of these cylindrical pins 72, 74 must meet and form a straight line in the imaginary common central point of the firmly clamped hemispheres 65, 66.

Figure 5:
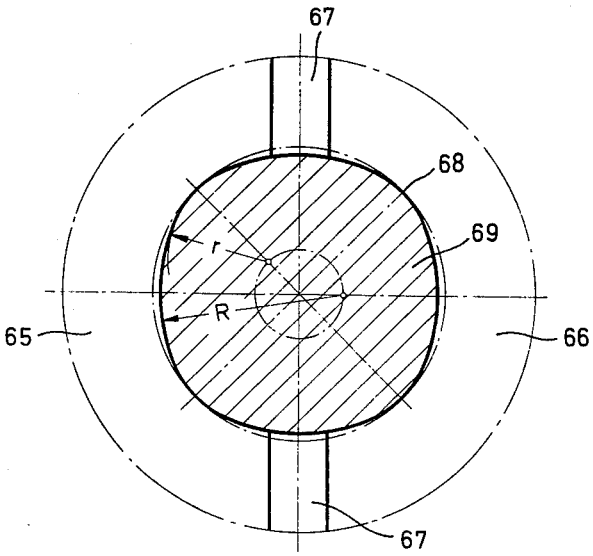
FIG. 5 shows a cross-section through the retaining and adjusting device taken on the line V—V in FIG. 4.

This embodiment, illustrated in FIGS. 4 and 5, has over the previously described embodiment the advantage that it can be clamped by a single movement and also adjusted in any direction (with the exception of rotation about the longitudinal axis of the rod 69).

Figure 6:
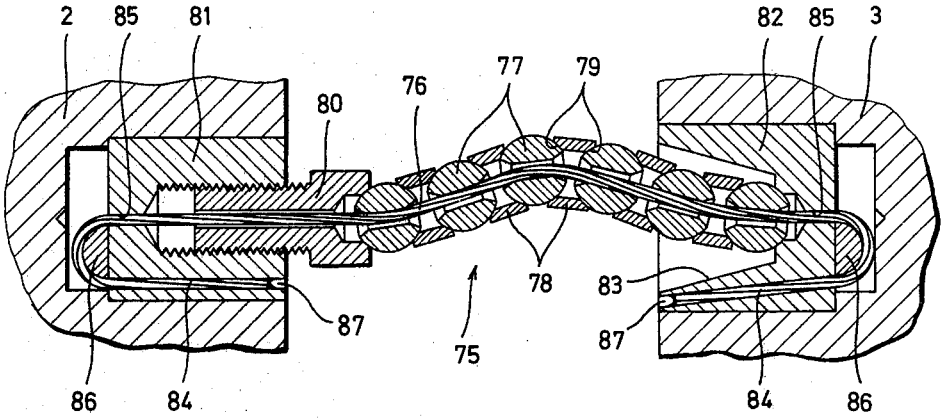
FIG. 6 is a cross-sectional view of a fifth embodiment of the retaining and adjusting device.

FIG. 6 shows another embodiment of an articulating mechanism which is based on a completely different principle. This is a multi-joint column which, in the manner of a chain 75, is composed of a steel wire strand 76 which can be subjected to high tractive forces and which has, arranged on it in alternating sequence, centrally drilled balls 77 and short cylindrical tube portions 78. The balls 77 and the tube portions 78 have the same outside diameter. Embedded in the two end faces of each tube portion 78 and corresponding to the shape and size of the balls 77 are short socket rings 79 against which the surfaces of the balls can bear. The left-hand outer end of the chain 75 consists of a centrally drilled tensioning screw 80 with a hexagonal head, of which the threaded part is remote from the chain and which is screwed into a block 81 anchored rigidly in the stock 2. The other end of the chain 75 is supported on a block 82 anchored in a space in the pistol grip 3. The block 82 has a conical inner recess 83 which permits of a somewhat longer length of chain 75 and transverse movements thereof. The two ends 84 of the steel wire strand 76 are passed through central bores 85 in the blocks 81, 82, are passed around semi-cylindrical supports 86, and each is rigidly soldered in an anchoring bore 87 in the relative block, located in the vicinity of the periphery and parallel with or slightly inclined in respect of the central bore 85.

The length of the steel wire strand 76 between the blocks 81, 82 is so dimensioned that when the clamping screw 80 is substantially screwed in, sufficient clearance for relative movements is provided between the individual chain links 77, 78. Subject to this condition, the chain 75 can easily follow an adjustment of the pistol grip in respect of the stock 2 in any direction by linking and stretching. In the desired position, the chain 75 is made rigid and immovable by a clearance-bridging unscrewing and subsequent tightening of the tensioning screw 80. In the tensioned condition, the individual chain links are pressed rigidly against one another by the tensioning screw 80 and as a reaction of this, the steel wire strand 76 is subjected to a traction loading which maintains the compressive forces in the chain links in balance. The Chain 75 can be made flexible again by slightly slackening off the tensioning screw 80.

FIGS. 7 and 8 show a further embodiment of articulating mechanism. The rifle which in this connection is also illustrated to clarify the installation conditions was already at the commencement of the descriptions of the examples of embodiment. The articulating mechanism comprises a swivel joint 88 consisting of a clamping piece 89 having two intersecting bores with bolts 90 and 91 mounted therein for displacement and rotation, whereby a U-shaped member 92 is welded onto the ends of the first bolt 90 while a similar U-shaped member 93 is welded onto the ends of the other bolt 91. The U-shaped member 93 is secured on the pistol grip 3 by means of a screw 94, while the U-shaped member 92 is rotatably and displaceably guided via a third bolt 95 welded on the base thereof, so that it is rotatable and slideable in a mounting 96 which is rigidly inserted in the stock 2. The longitudinal axis of the bolt 95 is at right-angles to those of the bolts 90 and 91 and perpendicular to the plane in which the longitudinal axes of the bolts 90, 91 are at right-angles to each other. The articulating mechanism thus permits of triple-axial movements.

For securely clamping the two bolts 90 and 91 in the bores in the clamping member 89, a slot 97 opening up the long side of the relevant bore and a clamping screw 98 disposed transversely of this slot 97 are provided. The third bolt 95 can be clamped in the mounting 96 by two identical clamping screws 99 which, being screwed into the mounting 96, press directly on the surface of bolt 95. The heads of the clamping screws 99 are accessible from outside by an aperture 100 in the stock 2.

Graduations on the various joints serve to make certain settings easily reproducible. These graduations consist of graduation marks 101 disposed at brief axial distances one after another on the cylindrical surface of each bolt 90, 91 and 95, and an axially parallel graduation 102 and several graduations 103 (FIG. 8) which are radially orientated at regular intervals on the end faces of the bores receiving the bolts. The graduations 101 to 103 are paint-filled pit-like depressions in the relevant part. The graduations 103 can however also be printed on film which is then fixed in position by adhesion.

FIG. 9 illustrates yet another embodiment of the articulating mechanism which can be used on a pistol grip 3 with integrated trigger guard 6. In this case, the trigger guard 6 has, extending in the firing direction of the rifle, a projection 104 with an equi-directional bore 105 in which one end of a bent cylindrical rod 106 is rotatably and displaceably mounted. The rod 106 is furthermore adapted to be clamped in the bore 105 by providing a longitudinal slot 107 in projection 104 and two clamping screws 108 which draw together the portions of the opposed projection and of which only one can be seen in the drawing.

Fixed at the other end of the bent rod 106 is a ball 109 which is rotatably and lockably mounted in a socket 110 which consists of a threaded bush 111 screwed securely in the front part of the stock 2, with, disposed within it, socket rings 112 and 113, the socket rings 113 being pressed against the ball 109 by a threaded ring 114.

This articulating mechanism is not so universally adjustable as the others. This is however due to the simpler construction and not to the fact that it is mounted on the trigger guard 6 and on the front stock. For this type of firing position, of course, the other articulating mechanisms are also suitable if their rods are bent.

As has already been indicated in the preamble to the description, there are possibilities of combining different structural features from different alternative embodiments. For example, the sleeve construction 56/57/61 of the rod 55 in FIG. 3 can be combined with balls 13, sockets 17 and hydraulics 26/27/28/31 as shown in FIG. 1 or with balls 109, sockets 110 and threaded rings 114 as shown in FIG. 9, to provide a new articulating mechanism.

The invention in which an exclusive property or privilege is claimed as follows:

1. In a fire arm wherein a body member includes a stock portion and a pistol grip portion, the improvement comprising at least one adjustable articulation mechanism interconnecting the pistol grip portion to the body member for universal and spaced adjustable movement relative thereto, and locking means for securing said mechanism in fixed position to retain said pistol grip portion in a preselected relationship with respect to said body member.

2. The improvement of claim 1 wherein each said mechanism comprises a plurality of articulation units cooperatively connected in spaced relationship to each other to provide rotary and longitudinal spaced adjustment of said pistol grip portion with respect to said body member, one of said units being a first socket means fixed to said body member, a second socket means fixed to said pistol grip portion and connecting means between said first and second socket means, said connecting means including first and second ball members rotatively engaged within the respective first and second socket means, and a rod connecting said ball members.

3. The improvement of claim 2 wherein said locking means comprises a clamping means cooperatively associated with each said socket means for locking said first and second ball members in fixed position in its respective socket means.

4. The improvement of claim 3 wherein one of said clamping means comprises a two-part socket which has a separating gap extending generally transversely of the longitudinal axis of said rod, one of said socket parts being constructed as a hydraulic piston displaceably disposed in a closed cylindrical bore, and hydraulic fluid means for operating said socket piston to clamp the ball member between said two parts.

5. The improvement of claim 4 wherein said hydraulic fluid means for operating said socket piston comprises a hydraulic fluid reservoir formed as a cylinder in said body member, hydraulic fluid in said reservoir communicating with said socket piston a piston means in said reservoir cylinder acting on said hydraulic fluid and a screw means to operate said reservoir piston to control the pressure of said hydraulic fluid.

6. The improvement of claim 3 wherein at least one of said first and second socket means comprises spaced first and second ring means, each of said ring means encircling a part of said ball member, said clamping means comprises a screw means for adjusting the spacing between said ring means for selectively releasably clamping the respective ball member in position relative to said socket means.

7. The improvement of claim 3 wherein at least one of said ball members is a multi-part ball.

8. The improvement of claim 2 wherein said first ball member is rigidly connected to a first end of said rod, and said second ball member includes a threaded through bore, a second end of said rod being provided with screw threads cooperatively engaging said through bore.

9. The improvement of claim 3 wherein at least one of said ball members is of two part construction defining a central cylindrical through bore between the respective parts of said two part ball member the respective parts being separated by a gap and said rod comprises a cylindrical rod accommodated in said through bore.

10. The improvement of claim 3 wherein at least one of said first and second ball members comprises a two part ball, the parts of said ball defining a through bore therebetween of noncircular cross-section and wherein said rod has a noncircular cross-section having a portion fitting in said through bore for rotational movement about the rod axis between ball-releasing and ball-clamping positions.

11. The improvement of claim 3 wherein at least one of said ball members comprises a two-part ball, the parts of said ball member defining a conical threaded through bore between the respective parts, the respective parts being separated by a gap, said rod having a threaded portion cooperatively engaging in said threaded conical bore, and said rod is a two part rod with a first part thereof having receiving means for a second part thereof, said receiving means having clamping means for selectively releasably clamping the second part of the connecting means in a required position relative to the first part.

12. The improvement of claim 1 wherein said adjustable articulation mechanism comprises an elongated flexible member, a separate block fixed to each end of said elongated member, one of said blocks being fitted on said body member and the other of said blocks being fitted in the pistol grip portion, an array of perforated balls alternating with cylindrical members threaded on said elongated member, and said locking means comprises tensioning means threaded onto said elongated member in a position interposed between said array and at least one of said blocks for placing tension on said elongated member and compression on said array to selectively and releasably lock the pistol grip portion in a position relative to the body member.

13. The improvement of claim 12 wherein the elongated member is a multi-stranded steel wire.

14. The improvement of claim 12 wherein said tensioning means is a tensioning screw threadably received in a bore in said one of said blocks.

15. The improvement of claim 1 wherein said adjustable articulation mechanism comprises a universal joint having two U-shaped members each with arms and a base, each U-shaped member having a bolt fixed between the arms thereof, a clamping piece defining two separate respectively perpendicular through bores, clamping means in said clamping piece for selectively clamping the respective bolts, said bolts being received in said through bores and being selectively and releasably lockable by said clamping means, said base of one of said U-shaped members being rigidly fixed to said pistol grip portion, a third bolt rigidly fixed to the base of the other of said U-shaped members and perpendicular to said first mentioned bolts, mounting means in said stock portion for said third bolt and clamping means in said mounting means for selectively and releasably clamping said third bolt.

16. The improvement of claim 15 wherein the said mounting means is secured in the pistol grip portion and said one of said U-shaped members is fixed on the stock portion.

17. In the improvement of claim 15 wherein said bores defined by said clamping piece and said mounting means have radial graduations and said bolts have complementary longitudinal graduations.

18. The improvement of claim 2 wherein said rod is a rectilinear rod.

19. The improvement of claim 1 wherein said adjustable articulation mechanism comprises a bent rod, a ball member at one end of said rod, a socket means formed in said body member, said ball member being received in said socket means, and journal bearing means forming a connection between the other end of said rod and said pistol grip portion.

20. The improvement of claim 19 wherein the pistol grip portion includes a tripper guard and said journal bearing means connects said other end of said rod to said trigger guard.

21. The improvement of claim 1 including a plurality of adjustable articulation mechanisms and locking means inter-connecting said body member and said pistol grip portion.

* * * * *